United States Patent [19]

Anzai et al.

[11] Patent Number: 4,542,981

[45] Date of Patent: Sep. 24, 1985

[54] DEGRADATION COMPENSATION OF PHOTORECEPTOR SENSITIVITY FOR ELECTROPHOTOGRAPHIC COPYING MACHINE

[75] Inventors: Shunju Anzai; Yoshiaki Imanaka, both of Nara, Japan

[73] Assignee: Sharp Kabushiki Kaisha, Osaka, Japan

[21] Appl. No.: 587,112

[22] Filed: Mar. 7, 1984

[30] Foreign Application Priority Data

Mar. 8, 1983 [JP] Japan ..... 58-39465

[51] Int. Cl.[4] ..... G03G 15/00; G03G 15/06

[52] U.S. Cl. ..... 355/14 E; 355/14 CH; 355/14 D; 355/14 R; 355/30

[58] Field of Search ..... 355/14 E, 14 CH, 10, 355/14 R, 14 D, 30

[56] References Cited

U.S. PATENT DOCUMENTS

| | | | |
|---|---|---|---|
| 3,666,363 | 5/1972 | Tanaka et al. | 355/10 X |
| 4,408,871 | 10/1983 | Kojima | 355/14 CH X |
| 4,416,536 | 11/1983 | Itoh et al. | 355/14 E |
| 4,431,301 | 2/1984 | Hashimoto et al. | 355/14 CH |
| 4,432,634 | 2/1984 | Tabuchi | 355/14 CH X |
| 4,433,297 | 2/1984 | Buchheit | 355/14 CH X |
| 4,445,772 | 5/1984 | Aoki et al. | 355/14 CH X |
| 4,448,512 | 5/1984 | Bean | 355/14 CH X |
| 4,451,137 | 5/1984 | Farley | 355/14 CH X |

FOREIGN PATENT DOCUMENTS

| | | | |
|---|---|---|---|
| 2748325 | 12/1978 | Fed. Rep. of Germany | 355/14 E |
| 2911511 | 9/1980 | Fed. Rep. of Germany | 355/14 E |
| 0076828 | 7/1978 | Japan | 355/14 E |
| 0161943 | 12/1979 | Japan | 355/14 E |

*Primary Examiner*—A. T. Grimley
*Assistant Examiner*—Terry Flower
*Attorney, Agent, or Firm*—Birch, Stewart, Kolasch & Birch

[57] ABSTRACT

An electrophotographic copying machine is provided having a photoreceptor, a corona discharger, a lamp, and a compensation circuit. The corona discharger is activated to provide a corona discharge toward the photoreceptor to uniformly and initially charge the surface of the photoreceptor. The lamp is illuminated at the same time as the corona discharge of the corona discharger to improve the charging on the photoreceptor. The compensation circuit is activated to provide an exponential voltage to be applied to the lamp in proportion to the sensitivity degradation of the photoreceptor, to thereby compensate the sensitivity degradation of the photoreceptor.

4 Claims, 5 Drawing Figures

DEGRADATION COMPENSATION OF PHOTORECEPTOR SENSITIVITY FOR ELECTROPHOTOGRAPHIC COPYING MACHINE

BACKGROUND OF THE INVENTION

The present invention relates to an electrophotographic copying machine and, more particularly, to sensitivity compensation of a photoreceptor for an electrophotographic copying machine.

An electrophotographic copying machine produces an electrostatic latent image onto a photoreceptor corresponding to an image on a document such as a manuscript or book to be copied. Toner particles are electrostatically adhered to the latent image so that the latent image becomes visible as a toner image. The toner image on the photoreceptor is transferred onto a copy paper via a transference charger. The remaining toner particles and charges on the photoreceptor after transfer to the copy paper are removed for the next copying operation.

Conventionally, the sensitivity of the photoreceptor may inevitably be changed while a plurality of copies are formed. The sensitivity increases after the first several copies have been formed. The sensitivity is not changed as much while a plurality of copies are continuously formed. If the copying operation is stopped for a while, for example, several minutes or more, the sensitivity gradually worsens.

To stabilize the sensitivity of the photoreceptor, the photoreceptor is usually rotated without forming any latent image thereon prior to the start of the copying operation while the other steps are subjected to the photoreceptor in the same manner as when forming the latent image. After these precopy operations are carried out, the copying operation is performed. This complete pre-copy operation takes a long time to perform whereby it takes a long time when copying even a single copy.

The pre-copy operations can be eliminated. For example, the charge voltage on the photoreceptor by the discharger may be detected so that the voltage to be applied to the discharger can be changed. Otherwise, a light source for emitting scanning light toward the document to form the latent image on the photoreceptor can be changed. However, these need the complexity of the conventionally required system which is costly.

SUMMARY OF THE INVENTION

Accordingly, it is an object of the present invention to provide an improved photoreceptor forming a continuously clear latent image thereon regardless of the sensitivity of the photoreceptor.

It is another object of the present invention to provide a novel compensation for the sensitivity of the photoreceptor in an electrophotographic copying machine.

It is a further object of the present invention to provide a novel system for compensating the sensitivity of a photoreceptor in an electrophotographic copying machine, such that the amount of light to be applied to the photoreceptor is improved.

Briefly described, in accordance with the present invention, an electrophotographic copying machine comprises a photoreceptor, a corona discharger, a lamp, and a compensation circuit. The corona discharger is activated to provide a corona discharge toward the photoreceptor to uniformly charge the surface of the photoreceptor. The lamp is illuminated at the same time as the corona discharge of the corona discharger to improve the charging of the photoreceptor. The compensation circuit is activated to provide an exponential voltage to be applied to the lamp proportional to the sensitivity degradation of the photoreceptor, to thereby compensate for the sensitivity degradation of the photoreceptor.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

As the time increases during which an electrophotographic copying machine is not copying, the sensitivity of a photoreceptor worsens. According to the present invention, an amount of light to be applied to the photoreceptor is changed depending upon the length of time the copying machine has not been copying. The sensitivity of the photoreceptor may be changed according to an exponential function of either the copying time or the noncopying time. According to the present invention, a compensation circuit is provided for generating exponential function signals according to the copying operation time and the noncopying operation time. Responsive to the output of the compensation circuit, a lamp is operated for emitting light toward the photoreceptor. That is, when the copying operation is started under the condition that the sensitivity of the photoreceptor is poor, a larger voltage is applied to the lamp so that a greater amount of light is emitted toward the photoreceptor to improve the charge transfer in the same degree as in the case of good sensitivity to thereby compensate for the poor sensitivity of the photoreceptor.

Figure 1:
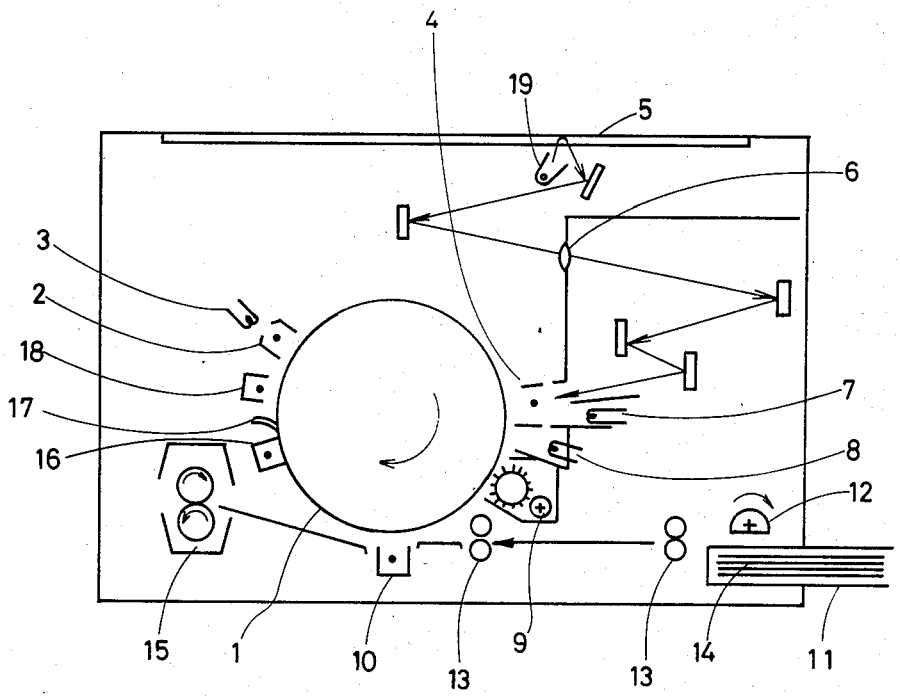
FIG. 1 is a schematic cross-sectional view of an electrophotographic copying machine according to the present invention.

FIG. 1 shows a schematic side cross-sectional view of an electrophotographic copying machine in accordance with the present invention.

Referring to FIG. 1, a three-layered photoreceptor 1 is disposed around a rotational drum. The photoreceptor 1 comprises an electrically conductive base made of Al, a photoconductive layer made of CdS thereon, and an insulative layer made of MYLAR thereon. An example of such a three-layered element and an electrophotographic process therewith is disclosed in H. TANAKA et al, U.S. Pat. No. 3,666,363 issued on May 30, 1972, entitled "ELECTROPHOTOGRAPHCI PROCESS AND APPARATUS". The disclosure of this patent is incorporated herein by reference.

A first corona discharger 2 is provided for initially and uniformly charging the surface of the photoreceptor 1 in a certain polarity. A lamp 3 is provided for emitting light toward the photoreceptor 1 simultaneously with the activation of the discharger 2 to improve the charging of the photoreceptor 1. A light exposing device 19 is provided for emitting light toward the document mounted on a document table 5 as the document table 5 is reciprocated in accordance with the rotation of the drum carrying the photoreceptor 1, so that the reflected light beams are incident on the photoreceptor 1 through a lens system 6 comprising mirrors and a lens to form an electrostatic latent image. A second corona discharger 4 is provided for passing the reflected light beams toward the photoreceptor 1 and providing an AC corona discharge having a polarity opposed to that of the first corona discharger 1. A charge removing lamp 7 is provided for emitting light beams toward the photoreceptor 1 simultaneously with the corona discharge of the second corona discharger 4 to remove charges positioned at nonimaged portions (for example, the non-light exposed portions in the copy size shrinkage). A light exposure lamp 8 is provided for uniformly providing light beams toward the entire surface of the photoreceptor 1, after the latent image forming, to enhance the contrast of the formed latent image.

A developing device 9 is provided for developing the latent image with toner particles to form a toner image. A transference discharger 10 is provided for transferring the toner image onto a copy paper picked up from a number of copy papers 14 stored within a cassette 11. Paper pick-up rollers 12 are provided for picking up a single copy from the papers 14 in the cassette 11. Paper feeding rollers 13 are provided for feeding the picked-up copy paper into the transference discharger 10.

A first charge-removing corona discharger 16 is provided for charging the photoreceptor 1 in a polarity opposed to the polarity of the remaining charges on the photoreceptor 1 to remove the charges from the photoreceptor 1. A cleaning device 17 is provided for removing the remaining toner particles from the surface of the photoreceptor 1. A second chargeremoving corona discharger 18 is provided for removing the remaining charges from the photoreceptor 1. A pair of fixing rollers 15 are provided for pressing the toner image onto the copy paper to fix the toner image thereon. A pair of exhaust rollers may be provided for expelling the copied paper from the body of the copying machine to place the copied paper onto a receiving tray.

It is to be noted that the application of the present invention should not be limited to a copying machine of the type in FIG. 1.

According to the present invention, the lamp 3 is switched on for emitting an amount of light proportional to the sensitivity degradation of the photoreceptor 1 toward the photoreceptor 1 simultaneously with the corona discharge of the first corona discharger 2. Since the sensitivity of the photoreceptor 1 changes exponentially, the lighting of the lamp 3 is exponentially changed also.

Figure 2:
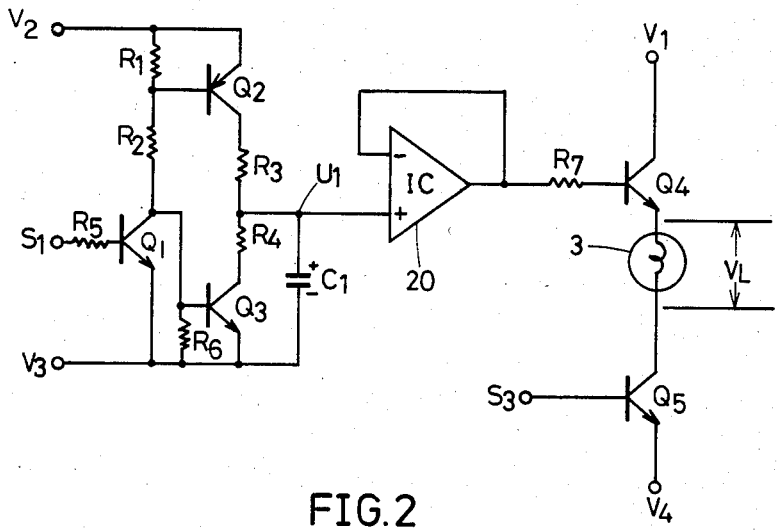
FIG. 2 shows a block diagram of a sensitivity control circuit according to the present invention.

FIG. 2 is a block diagram of a circuit in the electrophotographic copying machine for activating the lamp 3 exponentially according to the present invention. The circuit of FIG. 2 comprises the lamp 3, an operational amplifier 20, a condenser C1, transistors Q1, Q2, Q3, Q4, and Q5, and resistances R1 to R7.

A signal S1 is applied to the base of the transistor Q1 via the resistance R5. The signal S1 is made low, "L", when the copying operation is carried out by the copying machine of FIG. 1. This signal S1 is made high, "H", when the copying operation is not carried out. The signal S1 is developed by a control circuit for operating the copying machine. Responsive to the application of power and the ready condition of the machine, the signal S1 is designed to be made "H". The collector of the transistor Q1 is coupled to a first power voltage V2 via the resistances R1 and R2 while the emitter of the transistor Q1 is coupled to a second power voltage V3. The connection between the resistances R1 and R2 is coupled to the base of the transistor Q2. The emitter of the transistor Q2 is coupled to the first power voltage V2 while the collector of the transistor Q2 is coupled to the collector of the transistor Q3 via the resistances R3 and R4. The base of the transistor Q3 is coupled to the collector of the transistor Q1 and, further, via the resistance R6, connected to the second power voltage V3. The emitter of the transistor Q3 is connected to the second power voltage V3. The condenser C1 is connected between the second power voltage V3 and the connection between the resistances R3 and R4. The values of the first and the second power voltages V2 and V3 are selected to be $V2 > V3$.

In the above circuit construction, when the transistor Q2 becomes conductive (ON), a charge current flows into the condensor C1 via the resistance R3. When the transistor Q3 becomes conductive, a discharge current flows from the condenser C1 via the resistance R4. The transistor Q1 thus controls the charging and the discharging of the condenser C1. That is, when the transistor Q1 becomes conductive, the collector voltage of the transistor Q1 is substantially identical with the second power voltage V3, so that the transistor Q2 becomes nonconductive and the transistor Q3 becomes conductive. Therefore, the charge current flows into the condenser Q1 via the resistance R3. At this time, the condenser C1 is charged at the following time constant $TAU_r$:

$$TAU_r = R3C1$$

When the transistor Q1 becomes nonconductive, the collector of the transistor Q1 becomes the voltage of the first power voltage V2, so that the transistor Q2 becomes nonconductive and the transistor Q3 becomes conductive. Therefore, the charged current in the condenser C1 is discharged via the resistance R4 and the transistor Q3. At this time, the time constant of the discharging of the condenser C1 is the following $TAU_f$:

$$TAU_f = R4C1$$

Figures 3A, 3B, 3C:
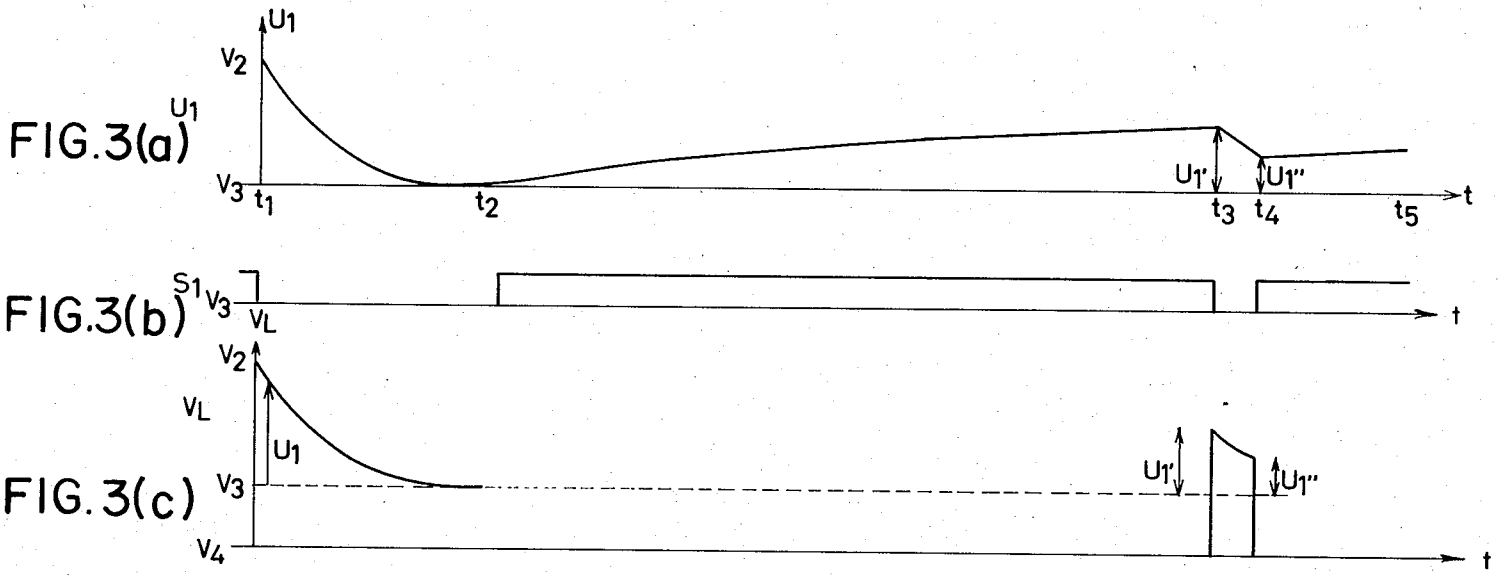
FIGS. 3(*a*)–3(*c*) are time charts of signals occurring within the circuit of FIG. 2.

The transistor Q1 is turned ON and OFF by the signal S1. During the copying period, the charge in the condenser C1 is discharged. During the copy ready period, the charging current flows into the condenser C1. FIGS. 3(*a*)–3(*c*) show timing charts of the signals in the circuit of FIG. 2. FIG. 3(*b*) relates to signal S1. Owing to the charging and the discharging of the condenser C1, a voltage U1 at the positive terminal of the condenser C1 is shown in FIGS. 3(*a*) and (*c*).

The positive terminal of the condenser C1 is connected to the non-reversible terminal "+" of the operational amplifier 20. The reversible terminal "−" of the operational amplifier 20 is connected to the output terminal of the amplifier 20. Thus, the operational amplifier 20 serves as a voltage follower circuit for providing an output voltage identical in level with an input voltage. Since the input impedance of the amplifier 20 is high and the output impedance thereof is low, the voltage U1 of the condenser C1 is not affected by the amplifier 20 so that the voltage U1 can be maintained.

The output of the operational amplifier 20 is inputted into the base of the transistor Q4 via the resistance R7.

The resistance R7 coupled to the base of the transistor Q4 and a third power voltage V1 to be applied to the collector of the transistor Q4 are both selected so that the emitter voltage of the transistor Q4 should have a voltage similar to the voltage U1 at the positive terminal of the condenser C1. A signal S3 is provided for controlling the ON and OFF of the lamp 3. During the copying period, the signal S3 is "H" to illuminate the lamp 3 and the signal S3 is "L" not to illuminate the lamp 3. The signal S3 is inputted into the base of the transistor Q5 whose emitter is connected to a fourth power voltage V4. Thus, the lamp 3 is connected across the emitter of the transistor Q4 and the collector of the transistor Q5. Here, the activation voltage of the lamp 3 can be defined by the charged voltage U1 of the condenser C1. The charged voltage U1 changes exponentially, as shown in FIGS. 3(*a*) and (*c*).

The values of the respective voltages satisfy the following relation:

$$V1 > V2 > V3 > V4$$

To operate the copying machine, power is applied placing the machine in a ready condition. The copying machine is operated only during the period t1–t2 as shown in FIG. 3(*a*) and signal S1 is turned "L" (FIG. 3(*b*)). Therefore, the transistor Q1 becomes nonconductive and the transistor Q3 becomes conductive, so that the charged voltage U1 of the condenser C1 is discharged according to the time constant $TAU_r$ (=C1 R4). The discharged voltage is applied to the transistor Q4 through the operational amplifier 20 serving as the voltage follower circuit. Therefore, the voltage applied to the lamp 3 is changed to be "V2+V3=VL" as shown in FIG. 3(*c*). Accordingly, in response to the application of the signal S3 (="H"), the lamp 3 is illuminated at the predetermined voltage.

That is, according to the present invention, after the copying machine has been inoperable for a while and the copying operation is started, the photoreceptor 1 (in particular the photoconductive layer) shows poor sensitivity so that decreased mobility of the charges is provided. In this case, a greater amount of light is applied to the photoreceptor 1 by the lamp 3, so that the charge mobility can be improved enough to uniformly charge the entire surface of the photoreceptor 1 to a level similar to that of normal sensitivity.

Under these circumstances, the light exposure to the document, the uniform light exposure onto the photoreceptor 1, and the developing operation are subsequently carried out to provide a normal copy density identical with the case of normal sensitivity of the photoreceptor 1 even when the photoreceptor 1 provides only poor sensitivity. The lamp 3, illuminated for uniformly charging the photoreceptor 1, is activated with an exponentially reducing voltage VL over time and as the number of the copied documents increases. That is, as the sensitivity of the photoreceptor 1 reaches its normal condition, the lamp 3 is activated with the voltage VL in an inverse proportion to the increasing sensitivity of the photoreceptor 1. The values of the condenser C1 and the resistance R4 are selected so that, when the sensitivity of the photoreceptor 1 is considered to be normal, all the charges are discharged from the condenser C1. After discharging, the lamp 3 is activated with the second power voltage V3.

At time t2, the copying operation is stopped and the copying machine is left in a ready mode, so that the signal S1 changes from "L" to "H". Accordingly, the condenser C1 is charged with the time constant TAU (=R3 C1). As shown in the change of voltage U1 in FIG. 3(*a*), the charging voltage of the condenser C1 gradually increases to the time t3. Once the copying operation is restarted after time t3, the lamp 3 is activated with a voltage similar to the charged voltage in the condenser C1, as shown in FIG. 3(*c*).

The time constants $TAU_r$ and $TAU_f$ are selected depending on the estimated reduction in sensitivity of the photoreceptor 1 so that the photoreceptor 1 will appear similar to its normal sensitivity.

In the above description, the voltage to be applied to the lamp 3 is varied in a manner proportional to the estimated degradation in sensitivity of the photoreceptor 1. A similar improvement may be applied to the light source 19 for emitting light toward the document. Further, these improvements may be applied to the charge removing lamp 7 and the uniform exposure lamp 8.

While only certain embodiments of the present invention have been described, it will be apparent to those skilled in the art that various changes and modifications may be made therein without departing from the spirit and scope of the present invention as claimed.

We claim:

1. An electrophotographic copying machine comprising:
   - photoreceptor means for forming a latent image thereon;
   - corona discharge means for providing corona discharging onto said photoreceptor means;
   - lamp means for emitting light toward said photoreceptor means simultaneously with the discharging of said corona discharge means; and
   - control means for controlling activation of said lamp means so that an amount of light emitted by said lamp means is proportional to an exponential degradation in the sensitivity of said photoreceptor means.

2. The electrophotographic copying machine of claim 1, wherein said control means includes means for providing an exponentially changing voltage to said lamp means in accordance with said exponential degradation of the sensitivity of said photoreceptor means.

3. The electrophotographic copying machine of claim 1, wherein said control means comprises a condenser and means for charging said condenser with an exponentially increasing voltage when said copying machine is not in use and means for exponentially discharging said condenser while said copying machine is used.

4. The electrophotographic copying machine of claim 1, wherein said control means controls an activation voltage to be applied to a plurality of lamps in said electrophotographic copying machine including a lamp for emitting light toward a document on a document table, a charge removing lamp for emitting light toward said photoreceptor means, and a uniformly emitting lamp for emitting light toward said photoreceptor means.

* * * * *